US007218986B2

(12) United States Patent
Yoshimura et al.

(10) Patent No.: US 7,218,986 B2
(45) Date of Patent: May 15, 2007

(54) SEWING MACHINE TO WHICH EMBROIDERY FRAME MOVING DEVICE IS DETACHABLY ATTACHABLE

(75) Inventors: Ayako Yoshimura, Nagoya (JP); Tomohiko Mori, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/387,889

(22) Filed: Mar. 24, 2006

(65) Prior Publication Data

US 2006/0219141 A1 Oct. 5, 2006

(30) Foreign Application Priority Data

Mar. 29, 2005 (JP) ..... 2005-093690

(51) Int. Cl.
*D05B 21/00* (2006.01)

(52) U.S. Cl. ..... 700/132; 112/102.5

(58) Field of Classification Search ..... 112/103, 112/102.5, 470.06, 102
See application file for complete search history.

(56) References Cited

U.S. PATENT DOCUMENTS 5,868,088 A * 2/1999 Mori et al. ..... 112/102.5
5,906,168 A * 5/1999 Ito et al. ..... 112/103
6,019,052 A * 2/2000 Stucki et al. ..... 112/102.5
6,158,365 A * 12/2000 Hidechika et al. ..... 112/103
6,293,212 B1 9/2001 Ebata et al.
6,439,142 B2 * 8/2002 Ebata et al. ..... 112/102.5

FOREIGN PATENT DOCUMENTS

| | | |
|---|---|---|
| JP | A-1-129878 | 5/1989 |
| JP | A-1-129879 | 5/1989 |
| JP | A-3-210296 | 9/1991 |
| JP | A-4-28391 | 1/1992 |
| JP | A-4-30889 | 2/1992 |
| JP | A-4-61883 | 2/1992 |

* cited by examiner

*Primary Examiner*—Danny Worrell
(74) *Attorney, Agent, or Firm*—Oliff & Berridge PLC

(57) ABSTRACT

A sewing machine includes an embroidery frame moving device detachably attachable to a sewing machine body and a control device. An embroidery sewing operation is executable when the embroidery frame moving device is attached to the body, and a normal sewing operation is executable when the moving device is detached from the body. The control device controls the sewing machine in a first stage under only a normal sewing mode in which the normal sewing operation is executed. The first stage ends when a detector detects the embroidery frame moving device initially attached to the body. The control device further controls the sewing machine in a second stage under either the normal sewing mode or an embroidery sewing mode in which the embroidery sewing operation is executed. The second stage starts after the detector has detected the embroidery frame moving device attached to the body.

12 Claims, 11 Drawing Sheets

SEWING MACHINE TO WHICH EMBROIDERY FRAME MOVING DEVICE IS DETACHABLY ATTACHABLE

CROSS-REFERENCE TO RELATED APPLICATIONS

This application is based upon and claims the benefit of priority from the prior Japanese Patent Application No. 2005-93690, filed on Mar. 29, 2005, the entire contents of which are incorporated herein by reference.

TECHNICAL FIELD

The present disclosure relates to a sewing machine comprising an embroidery frame moving device including an embroidery frame and an embroidery frame driving motor and a sewing machine body to which the embroidery frame moving device is detachably attached.

BACKGROUND

Conventional electronically controlled sewing machines include sewing machines capable of carrying out embroidery sewing as well as sewing machines carrying out normal sewing such as zigzag stitches, decorative stitches or the like. Since the embroidery sewing necessitates special mechanisms and special control manners, the sewing machines dedicated to the normal sewing are unable to carry out the embroidery sewing. Users carrying out the embroidery sewing also wish to carry out the normal sewing using the same sewing machine. To meet the demand, manufacturers have developed and sold sewing machines capable of carrying out both embroidery sewing and normal sewing.

The sewing machines capable of carrying out both embroidery sewing and normal sewing include a sewing bed formed into a free bed which is generally referred to as "free arm" and are constructed so that an embroidery frame moving device is detachably attachable to the free bed. For example, JP-A-10-52582 discloses a sewing machine with an embroidery frame moving device. In the disclosed sewing machine, a control mode is set at a normal sewing mode when the embroidery frame moving device is detached from the free bed, so that the normal sewing can be carried out by cloth feed by vertical movement of a needle bar and a feed dog. On the other hand, when the embroidery frame moving device is attached to the free bed, the control mode is set at the embroidery sewing mode, so that selection and edit of a pattern for embroidery sewing and embroidery sewing operation are executable.

To meet the demands of both users necessitating embroidery sewing and normal sewing and users necessitating only the normal sewing, the manufacturers have manufactured and sold sewing machines dedicated to the normal sewing and sewing machines capable of carrying out both embroidery sewing and normal sewing. Users carrying out only the normal sewing have purchased the sewing machines dedicated to the normal sewing, whereas users carrying out both embroidery sewing and normal sewing have purchased the sewing machines with detachably attachable embroidery frame moving devices which are capable of carrying out embroidery sewing and normal sewing.

However, in a case, a user firstly had no intention to carry out embroidery sewing and purchased a sewing machine dedicated to normal sewing. Now, he or she is interested in embroidery sewing and wishes to carry out embroidery sewing. In this case, the user needs to purchase a new sewing machine to which an embroidery frame moving device is detachably attachable. This results in inconvenience. Furthermore, it is manufacturer's burden to manufacture and sell two types of sewing machines, that is, sewing machine dedicated to normal sewing and sewing machines to which an embroidery frame moving device is detachably attachable.

As countermeasures against the aforementioned problems, it is suggested to sell, as a sewing machine dedicated to normal sewing, a sewing machine which is not provided with an embroidery frame moving device but to which an embroidery frame moving device is detachably attachable, so that a user who desires only the normal sewing would purchase such a sewing machine. However, conventional sewing machines to which an embroidery frame moving device is detachably attachable are designed so that patterns other than those for embroidery sewing is selectable and editable even when the embroidery frame moving device is not attached to the sewing machine in view of convenience. Accordingly, when the aforesaid sewing machine without an embroidery frame is sold as the sewing machine dedicated to the normal sewing, the user carrying out only the normal sewing would be perplexed about and troubled with unnecessary pattern selection for embroidery sewing, switches, display and operation for editing, or the like.

SUMMARY

Therefore, an object of the disclosure is to provide a sewing machine to which an embroidery frame moving device is detachably attachable, which sewing machine can be used both as a sewing machine dedicated to the normal sewing and as a sewing machine which can perform the embroidery sewing as well as normal sewing and which sewing machine can prevent a user from being perplexed about display, buttons, operation for the embroidery sewing or the like when used as a sewing machine dedicated to the normal sewing and can select and edit patterns other than those for embroidery sewing when used as a sewing machine which can perform both the embroidery sewing and the normal sewing.

To achieve the above-described or other objects, the disclosure provides a sewing machine to which an embroidery frame moving device is detachably attachable, which will hereinafter be referred to merely as "sewing machine." An embroidery sewing operation is executable when the embroidery frame moving device is attached to a sewing machine body, whereas a normal sewing operation is executable when the embroidery frame moving device is detached from the sewing machine body. The sewing machine of the disclosure includes a detector which detects the embroidery frame moving device attached to the sewing machine body. The sewing machine further includes a control device having two operation modes, that is, an embroidery sewing mode and a normal sewing mode. The detector detects the embroidery frame moving device initially attached to a sewing machine body by a user who purchased or leased the sewing machine. The control device stores a result of detection.

The control device controls the sewing machine under only the normal sewing mode before the embroidery frame moving device is initially attached to the sewing machine body. In this case, the control device controls the sewing machine so that no display, explanation, switch or the like peculiar to the embroidery sewing mode is provided, whereby the sewing machine is used as a sewing machine dedicated to the normal sewing by the user.

After the embroidery frame moving device is initially attached to the sewing machine body, the control device controls the sewing machine under either normal sewing mode or embroidery sewing mode according to selection by the user. The control device accepts pattern selection, edit or the like other than the embroidery sewing operation even when the embroidery frame moving device is not attached to the sewing machine body. When the embroidery sewing operation is instructed under the condition where the embroidery frame moving device is not attached to the sewing machine body, the control device warns the user. When the normal sewing mode is instructed under the condition where the embroidery frame moving device is attached to the sewing machine body, the control device also warns the user.

The user can use the sewing machine as a sewing machine dedicated to the normal sewing before the embroidery frame moving device is initially attached to the sewing machine body. In this case, display, explanation, switch or the like peculiar to the embroidery sewing mode is eliminated although the control device includes control functions under the embroidery sewing mode. Consequently, the user can devote himself/herself to the normal sewing without being perplexed by the display, explanation, switch or the like.

Furthermore, after the embroidery frame moving device is initially attached to the sewing machine body, the user can carry out either normal sewing mode or embroidery sewing mode according to his/her selection. The control device warns so that malfunction is prevented when the embroidery sewing operation is instructed without attachment of the embroidery frame moving device to the sewing machine body or when the normal sewing mode is selected with the embroidery frame moving device. Consequently, safe operation can be ensured.

BRIEF DESCRIPTION OF THE DRAWINGS

Other objects, features and advantages of the present invention will become clear upon reviewing the following description of an example with reference to the accompanying drawings, in which.

DETAILED DESCRIPTION OF THE INVENTION

Figure 1:
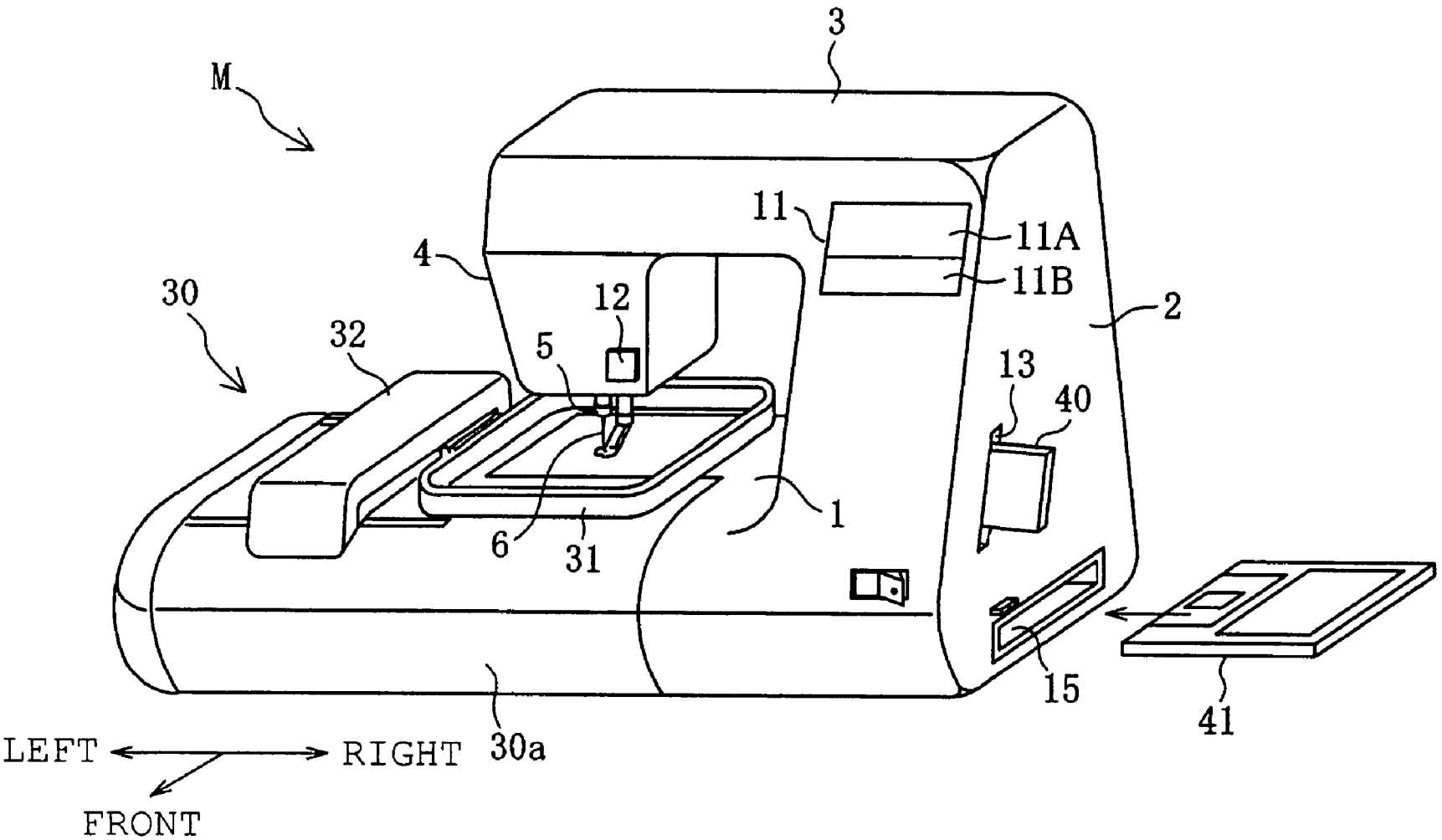
FIG. 1 is a perspective view of a sewing machine in accordance with an illustrative aspect of the present disclosure.

One embodiment in accordance with the present disclosure will be described with reference to the drawings. Referring to FIG. 1, a sewing machine of the embodiment to which an embroidery frame moving device is detachably attachable is shown. The sewing machine comprises a sewing machine body M to which an embroidery frame moving device 30 is attached as will be described later. The sewing machine body M comprises a sewing bed 1, a pillar 2 standing on a right end of the bed 1, an arm 3 extending frontward from an upper end of the pillar 2 so as to be opposed to the bed 2, and a head 4 mounted on the front of the arm 3.

A needle bar 5 provided with a sewing needle 6 is mounted on a lower end of the head 4 so as to be movable vertically and horizontally. The head 4 has a front side on which a start/stop switch 12 is mounted to instruct start and stop of a sewing operation. Inside the bed 1 are provided a feed dog vertically moving mechanism for vertically moving a feed dog for cloth feed, a feed dog horizontally moving mechanism moving the feed dog horizontally, a thread take-up device (a horizontally rotating shuttle, for example) and the like, none of which are shown. The feed dog horizontally moving mechanism is driven by a feed dog driving stepping motor 19 (see FIG. 2), whereas the feed dog vertically moving mechanism is driven by a sewing machine motor 17.

A card slot 13 and a disc slot 15 are formed in one side of the pillar 2. A read only memory (ROM) card 40 is inserted into the card slot 13 thereby to be connected to a control device 20 (see FIG. 2). A flexible disc 41 is inserted into the disc slot 15.

Inside the arm 3 are provided a needle bar vertically moving mechanism moving the needle bar 5 vertically, a needle bar swinging mechanism swinging the needle bar 5 in a direction perpendicular to a cloth feed direction, a thread take-up lever moving mechanism moving a thread take-up lever vertically in cooperation with the needle bar 5, and the like. The needle bar swinging mechanism is driven by a needle bar swinging stepping motor 18, whereas both needle bar vertically moving mechanism and thread take-up lever moving mechanism are driven by the sewing machine motor 17.

A display device 11A capable of displaying color image is mounted on a front side of the arm 3. The display device 11A includes a touch switch 11B which is disposed on a front face thereof and comprises transparent electrodes. The display device 11A and the touch switch 11B constitute a touch panel 11. When a user touches with his/her finger various operation keys or an embroidery pattern displayed on the display 11A, corresponding operation instructions or pattern selection is supplied to a control device 20.

A free bed (not shown) which is generally called "free arm" is formed on the left end of the bed 1. An embroidery frame moving device 30 is detachably attached to the free bed. The embroidery frame moving device 30 comprises a case 30*a*, an embroidery frame 31 to which work cloth is attached, a Y-direction drive mechanism 32 driving the embroidery frame 31 in the Y-direction (forth-and-back direction) and an X-direction drive mechanism accommodated in the case 30*a* for driving the embroidery frame 31 in the X-direction (right-and-left direction). The X-direction drive mechanism is driven by an X-direction stepping motor 33, whereas the Y-direction drive mechanism 32 is driven by a stepping motor 34.

When the embroidery frame moving device 30 has been attached to the free bed, the X-direction and Y-direction stepping motors 33 and 34 are connected via the connector 14 (see FIG. 2) to the control device 20. The control device 20 drives the sewing machine motor 17 so that the needle bar 5 is moved vertically. The control device 20 further drives the X-direction and Y-direction stepping motors 33 and 34 in synchronization with the vertical movement of the needle bar 5, so that the embroidery frame 31 is moved in the X and Y directions. The control device 20 controls an amount of movement of the embroidery frame 31 so that an embroidery pattern instructed by the user is drawn, whereby the instructed embroidery is formed on the work cloth.

Figure 2:
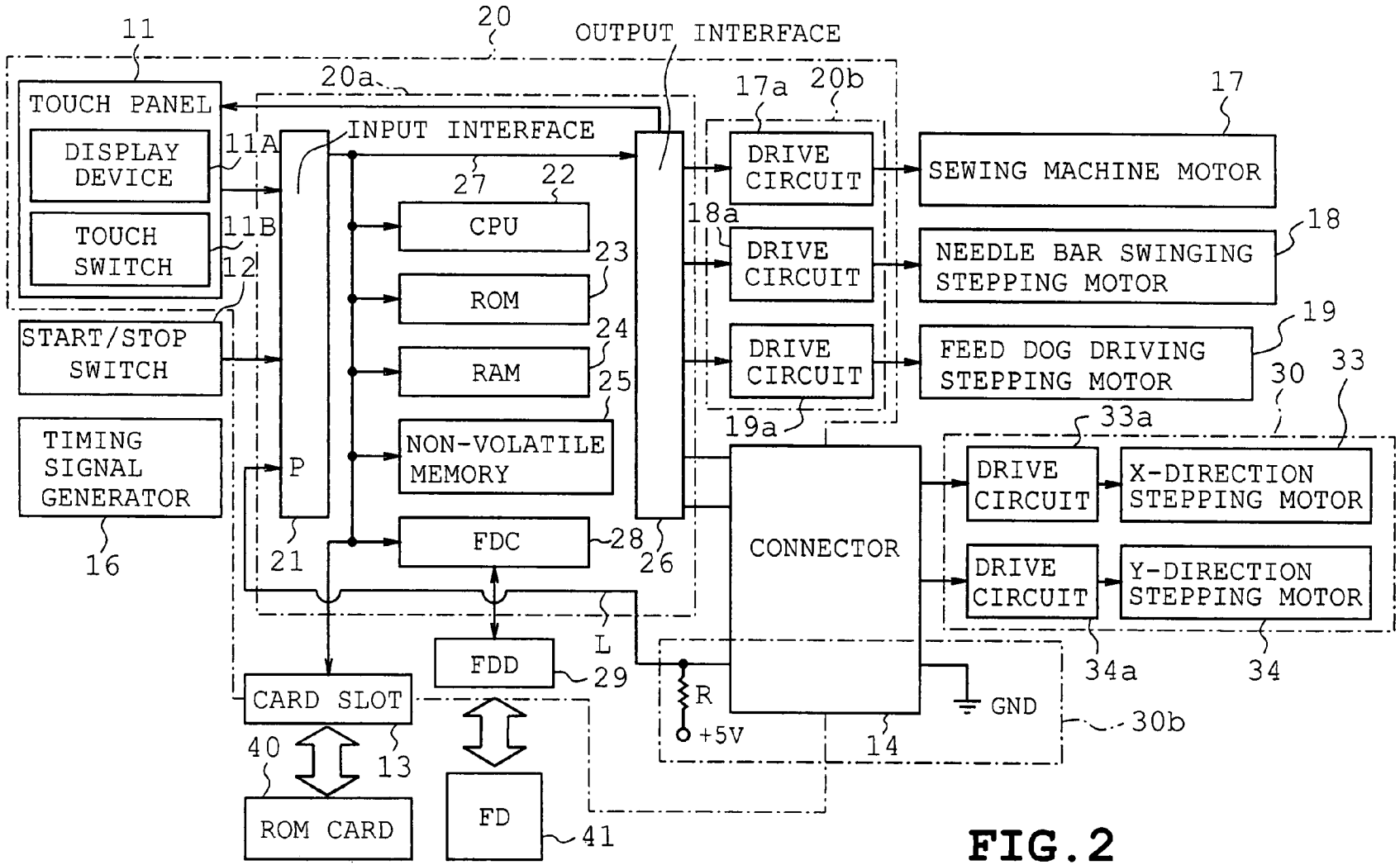
FIG. 2 is a block diagram showing the control system of the sewing machine shown in FIG. 1.

The arrangement of the control device 20 will now be described. FIG. 2 is a block diagram showing the control system of the sewing machine. The control device 20 which is the nucleus of the control system comprises a microcomputer 20*a*, the touch panel 11, a drive circuit group 20*b* and a flexible disc controller 28. The microcomputer 20*a* includes a well-known central processing unit (CPU) 22, a read only memory (ROM) 23, a random access memory (RAM) 24, a non-volatile memory 25, an input interface 21 and an output interface 26, all of which are connected to one another by a common buss 27.

The control device 20 has two operation modes, that is, a normal sewing mode and an embroidery sewing mode. In the normal sewing mode, a decorative pattern or utility pattern is sewn while work cloth is fed by the feed dog provided in the bed 1 without use of the embroidery frame moving device 30. In the embroidery sewing mode, an embroidery sewing is carried out with the embroidery frame moving device 30 being attached to the free bed. The ROM 23 stores control programs for carrying out the sewing under the aforementioned operation modes respectively, a program for driving peripheral devices, a program for executing control peculiar to the present disclosure and the like.

The RAM 24 is used as a working area. The non-volatile memory 25 is an electrically rewritable ROM and is accordingly used to store embroidery pattern data for execution of embroidery sewing, an enabling flag which will be described later, and the like. The flexible disc controller 28 controls a flexible disc drive 29, which is used for execution of data exchange between a flexible disc 41 and the ROM 23 or RAM 24. The ROM card 40 is adapted to be connected via the card slot 13 to the common bus 27. The ROM card 40 is used to write, for example, data of a new embroidery pattern on the non-volatile memory 25.

The touch panel 11 comprises the display device 11A and the touch panel 11B as described above and serves as a man-machine interface between the user and the control device. To the input interface 21 are connected the start/stop switch 12, the timing signal generator 16 and the touch panel 11. The start/stop switch 12 instructs start and stop of a sewing operation. The timing signal generator 16 delivers a synchronous signal pulse to inform the control device 20 of a rotational phase of a main shaft (not shown) driven by the sewing machine motor 17. The synchronous signal pulse is used in order that the main shaft may be rotated in synchronization with the drive mechanisms driven by the respective stepping motors.

The drive circuit group 20*b* is connected to the output interface 26. The drive circuit group 20*b* includes a drive circuit 17*a* for driving the sewing machine motor 17, a drive circuit 18*a* for driving a needle bar swinging stepping motor 18 and a drive circuit 19*a* for driving a feed dog driving stepping motor 19.

When the embroidery frame moving device 30 is attached to the free bed, a drive circuit incorporated in the device 30 is also connected via the connector 14 to the output interface 26. The embroidery frame moving device 30 further incorporates the drive circuit 33*a* for driving the X-direction stepping motor 33 and the drive circuit 34*a* for driving the Y-direction stepping motor 34.

To the input interface 21 is also connected a detector 30*b* for detecting the embroidery frame moving device 30 attached to the sewing machine body M. The detector 30*b* includes an interconnect line L pulled up to +5 V by a resistance R and having one end connected to an input port P of the input interface 21 and the other end connected to the ground potential GND at the embroidery frame moving device 30 side. The potential of the input port P is equal to the ground potential when the embroidery frame moving device 30 is attached to the free bed and it at +5 V when the embroidery frame moving device 30 is not attached to or detached from the free bed. The CPU 22 reads the voltage at the input port P of the input interface 21, thereby determining attached or detached state of the embroidery frame moving device 30.

The processing which is peculiar to the present disclosure and is carried out by the control device 20 will now be described with reference to the flowchart of FIG. 3. The sewing machine of the disclosure functions as a sewing machine dedicated to a normal sewing and a sewing machine which can execute both an embroidery sewing and a normal sewing. A user can use a purchased sewing machine as a special purpose machine without being perplexed by display and/or operation regarding the embroidery sewing. Another user who purchased a sewing machine and later the embroidery frame moving device 30 can carry out the embroidery sewing as well as the normal sewing when the device 30 is attached to the sewing machine.

In order that the aforementioned characteristic may be realized, the control device 20 stores the fact of attachment in the non-volatile memory 25 once the embroidery frame moving device 30 is attached to the sewing machine. A flag is provided for storing the fact in the non-volatile memory 25. The flag will hereinafter be referred to as"enabling flag." The enabling flag is set at "0" when the embroidery frame moving device 30 has never been attached to the sewing machine. The enabling flag is set at "1" when the embroidery frame moving device 30 has once been attached to the sewing machine.

When the enabling flag is set at "0," the control device 20 controls the sewing machine so that the sewing machine is dedicated to the normal sewing. When the enabling flag is set at "1," the control device 20 controls the sewing machine so that the sewing machine can execute both embroidery sewing and normal sewing. When the maker ships the sewing machine of the embodiment as sewing machine dedicated to the normal sewing, the enabling flag is set at "0." The enabling flag is set at "1" when the maker ships the sewing machine as a sewing machine which can execute both embroidery sewing and normal sewing.

The status of the flag needs to be rewritten from "0" to "1" when a user who purchased a sewing machine and later the embroidery frame moving device 30 carries out the embroidery sewing as well as the normal sewing. The control device 20 executes the rewriting based on a control sequence shown in FIG. 3.

The control sequence starts upon power supply to the control device 20. At S10, the control device 20 determines whether the enabling flag is set at "1." When the enabling flag is set at "1," the control device 20 finishes the control sequence. When the enabling flag is not set at "1" or is set at "0," the control device 20 proceeds to S11 to determine whether the embroidery frame moving device 30 is attached to the sewing machine. The aforementioned detector 30*b* is used in the determination at S11. When the embroidery frame moving device 30 is not been attached to the sewing machine, the control device 20 finishes the control sequence. When the embroidery frame moving device 30 is attached to the sewing machine, the control device 20 rewrites the enabling flag from "0" to "1" (S12).

Thus, when the user possessing the sewing machine dedicated to the normal sewing later purchases an embroidery frame moving device 30 and once attaches the device 30 to the sewing machine body M, the enabling flag is rewritten from "0" to "1." When the enabling flag is rewritten from "0" to "1," the control device 20 subsequently controls the sewing machine so that the sewing machine can execute both embroidery sewing and normal sewing. Consequently, the user can carry out the embroidery sewing as well as the normal sewing.

Next, referring to FIGS. 4A to 6, the case will be described where the control device 20 controls the sewing machine on the instructions of the user so that the sewing machine executes the embroidery sewing or the normal sewing. The control sequence of FIGS. 4A and 4B starts after power has been supplied to the control device 20 and the control sequence of FIG. 3 has been executed. At S21, the control device 20 determines whether the enabling flag is set at "1." When the enabling flag is not set at "1" or is set at "0," the control device 20 proceeds to S28.

When the enabling flag is set at "0," the control device 20 executes only the control of the normal sewing. More specifically, the control device 20 firstly provides an area for storing an operation mode in the RAM 24 and stores the normal sewing mode as the operation mode (S28). Subsequently, the control device 20 determines whether the start/stop switch 12 mounted on the head 4 is ON (S29). Although the start/stop switch 12 is an instantaneous contact switch, the control device 20 processes the start/stop switch 12 so that the switch 12 functions as an alternate switch. More specifically, when depressed while the sewing operation is not executed, the switch 12 is turned to the ON state, so that the sewing operation is initiated. When again depressed subsequently, the switch 12 is turned to the OFF state, so that the sewing operation is stopped.

Figure 5:
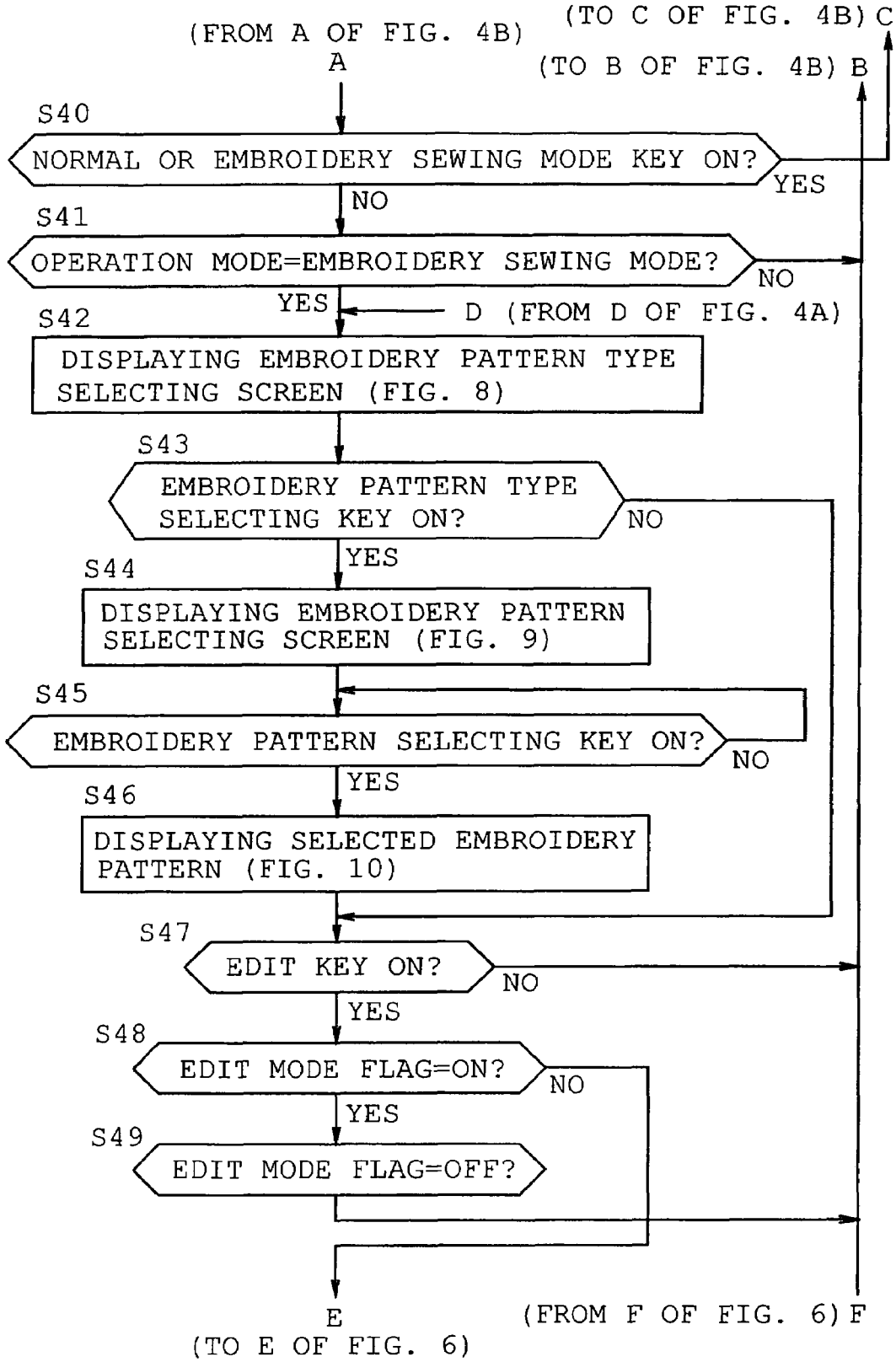
FIG. 5 is a flowchart showing the control continued from FIG. 4.
Figure 6:
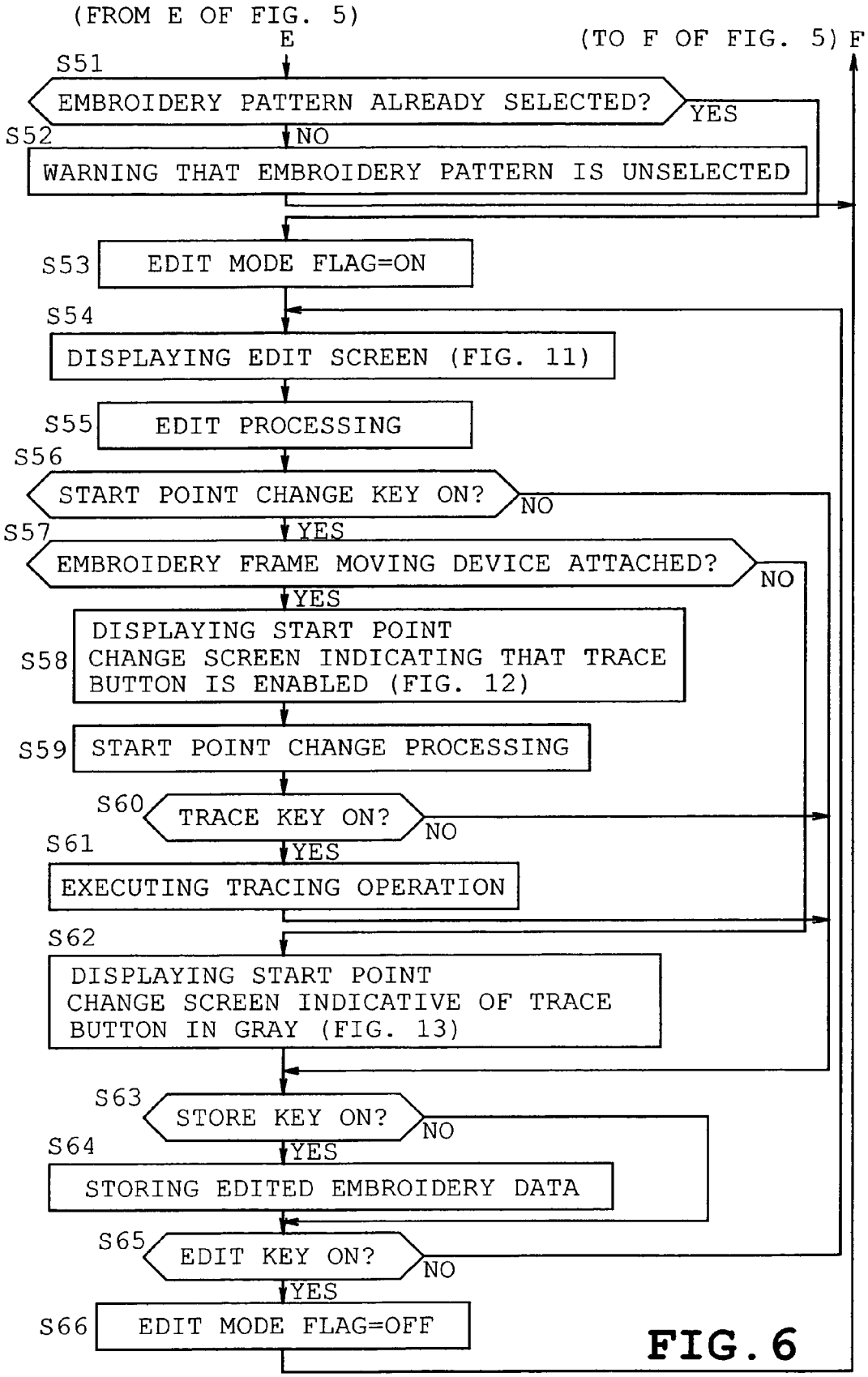
FIG. 6 is a flowchart showing the control continued from FIG. 5.

The control device 20 proceeds to S40 in FIG. 5 when the start/stop switch 12 is in the OFF state at S29. At S40, the control device 20 determines the status of mode selecting keys 11Ba and 11Bb which will be described later. The mode selecting keys 11Ba and 11Bb are not provided when the enabling flag is set at "0." The control device 20 then proceeds to S41 where the control device 20 determines whether the operation mode is set to the embroidery sewing mode. In this case, since the operation mode is set to the embroidery sewing mode, the control device 20 returns to S29. The control device 20 again checks the status of the start/stop switch 12. Thus, S29 is repeated until the start/stop switch 12 is turned ON. When the start/stop switch 12 is turned ON, the control device 20 proceeds to S30 where the control device 20 determines whether the operation mode is the normal sewing mode. Since the operation mode is the normal sewing mode in this case, the control device 20 proceeds to S31.

The control device 20 starts a sewing operation of the normal sewing at S31. The control device 20 drives the sewing machine motor 17, the needle bar swinging stepping motor 18 and the feed dog driving stepping motor 19 so that the sewing operation of the normal sewing is carried out. Subsequently, the control device 20 returns to S38 to determine whether the start/stop switch 12 has been turned ON. The control device 20 returns to S38 where the start/stop switch 12 has not been turned ON. S38 is repeated. The sewing operation of the normal sewing is continued until the start/stop switch 12 is again turned ON.

When the user again depresses the start/stop switch 12, the control device 20 proceeds to S39 to stop the sewing operation. Subsequently, the control device 20 proceeds to S40, returning via S40 and S41 to S29 again.

Thus, only the sewing operation of the normal sewing is executable when the enabling flag is set at "0" with the embroidery frame moving device 30 not being attached. In this case, the control device 20 does not display any indication regarding embroidery sewing, switches or the like although the control device 20 possesses programs and data regarding the embroidery sewing. Accordingly, the user can carry out the normal sewing by simplified operation of the sewing machine dedicated to the normal sewing without being perplexed by display or operation regarding the embroidery sewing.

Figure 3:
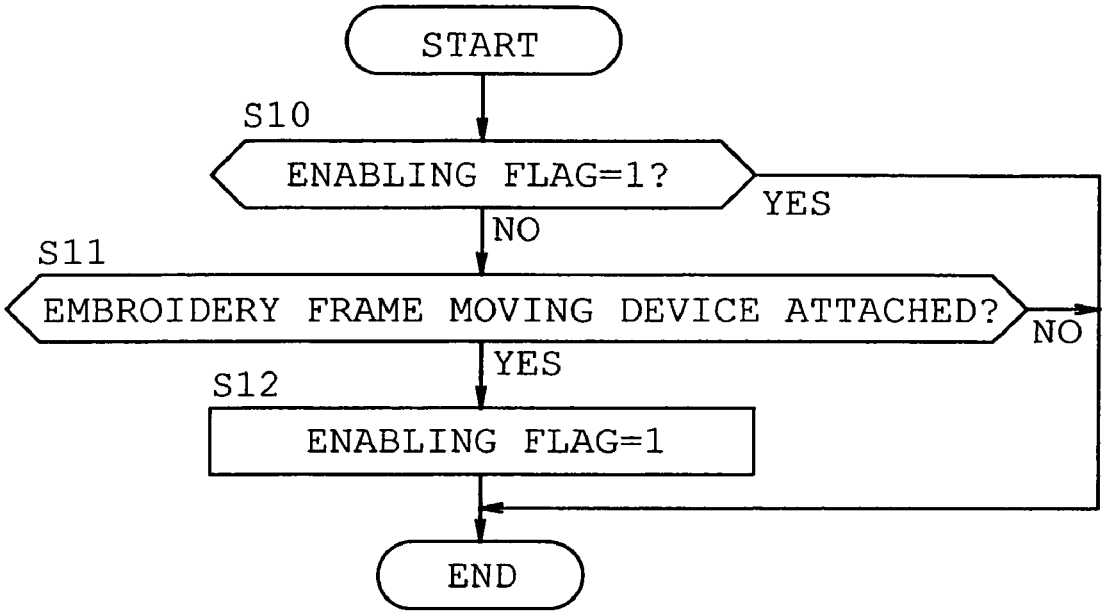
FIG. 3 is a flowchart showing the control regarding an enabling flag.
Figure 4A:
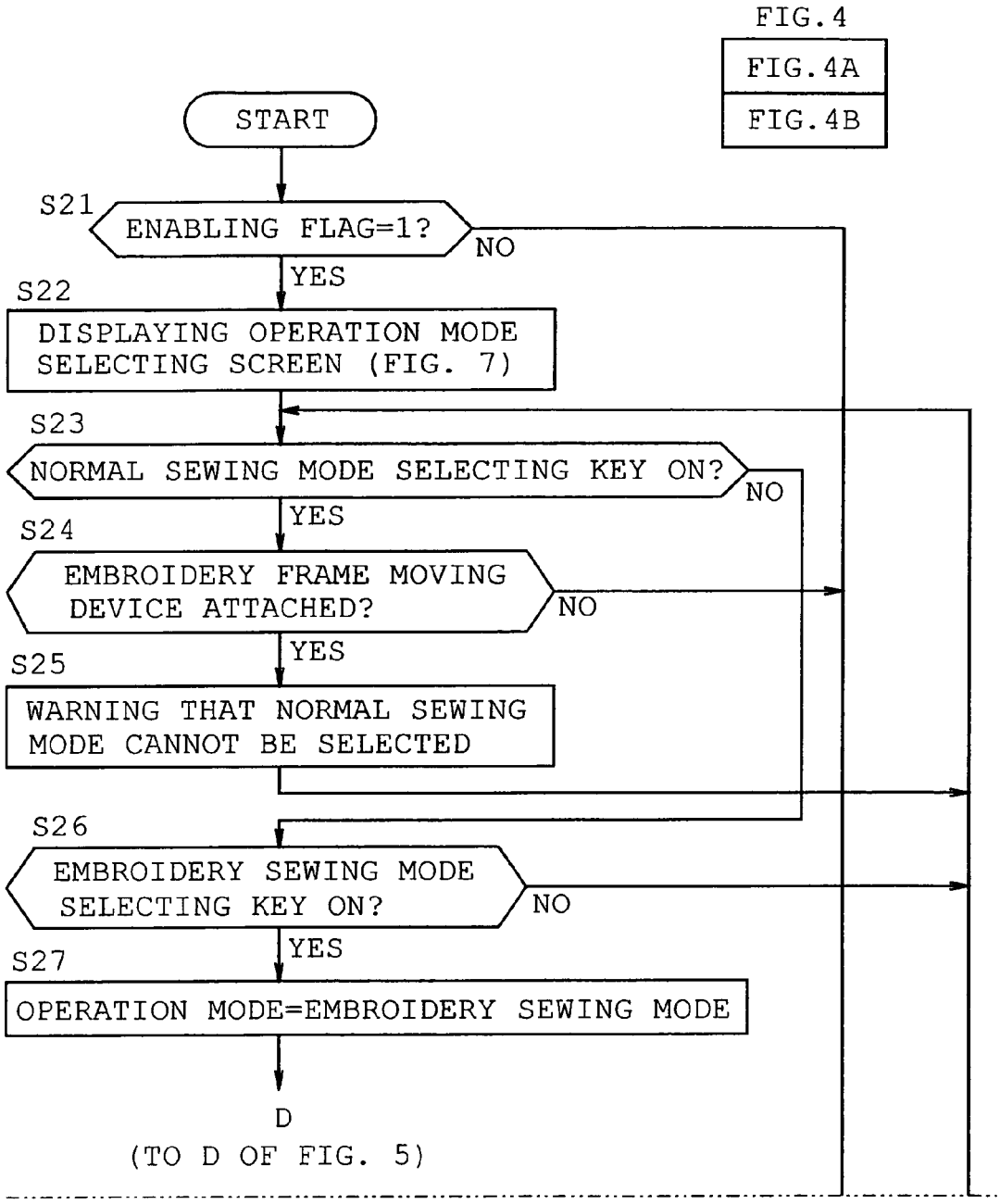
FIGS. 4A and 4B are flowcharts showing the control regarding the sewing machine.
Figure 4B:
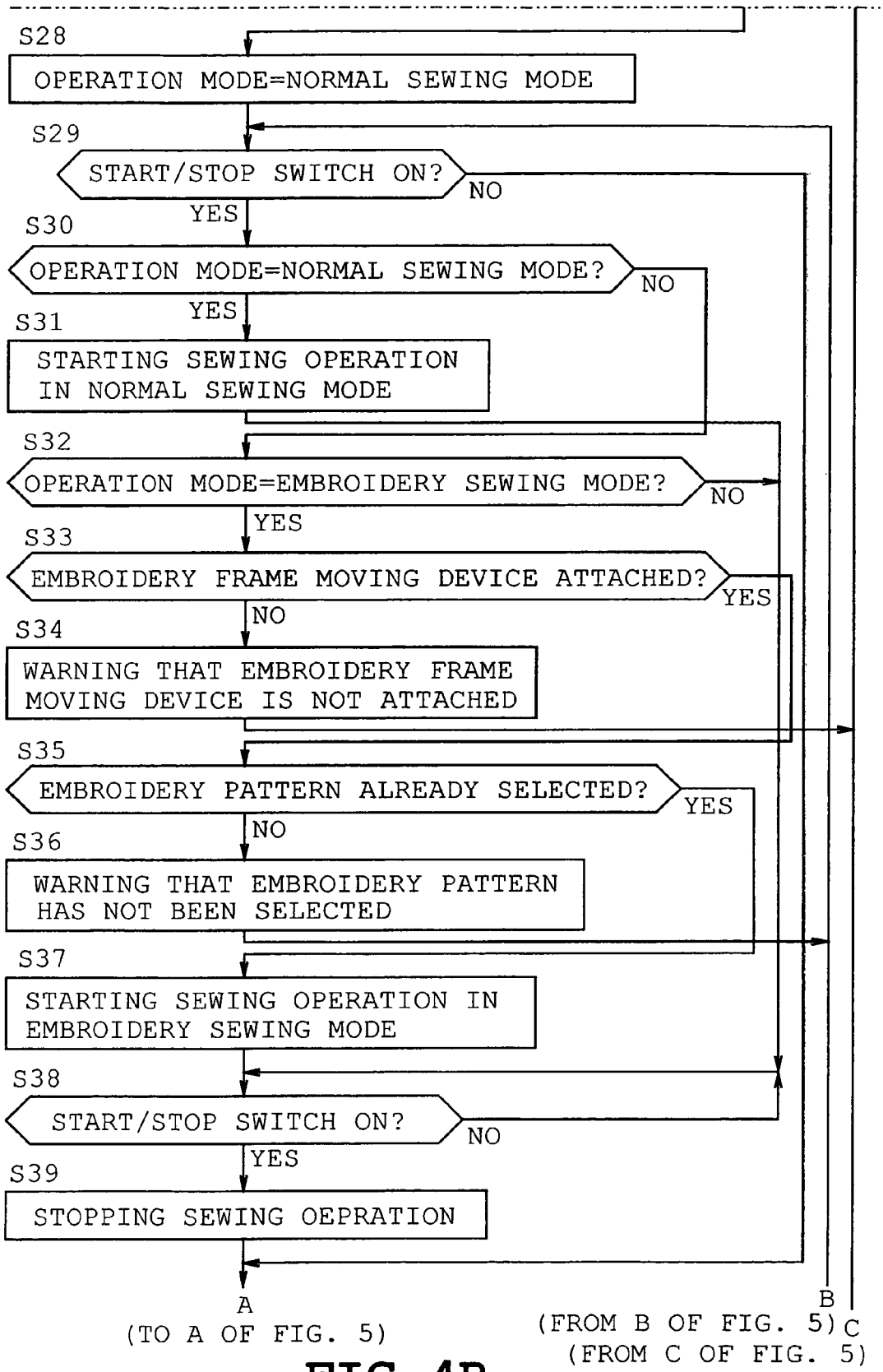

The following describes the control after the embroidery frame moving device 30 is once attached to the sewing machine body M and the enabling flag is set at "1" by the control sequence as shown in FIG. 3. The control device 20 proceeds to S22 when the enabling flag has been determined to be set at "1" (S21: YES).

Figure 7:
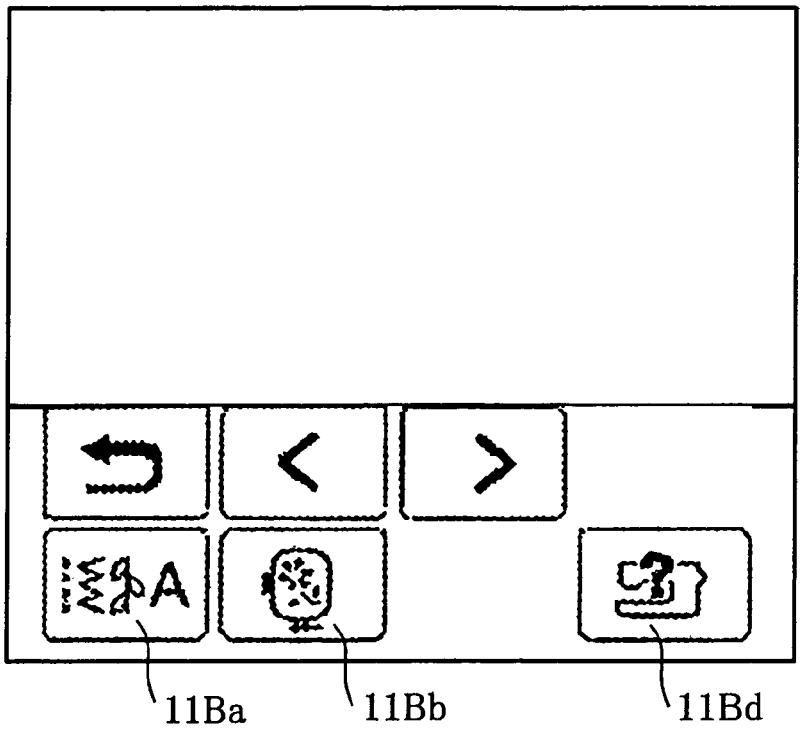
FIG. 7 shows an example of operation mode selecting screen.

After the enabling flag has been set at "1," either embroidery sewing or normal sewing can be executed by the option of the user. Accordingly, at S22, the control device 20 controls the touch panel 11 so that an operation mode selecting screen as exemplified by FIG. 7 is displayed on the touch panel 11. On the screen are displayed a plurality of keys including the normal sewing mode key 11Ba for selection of an operation mode of the control device 20, the embroidery sewing mode key 11Bb and a guidance key 11Bd. The guidance key 11Bd is provided for displaying the explanation of operation. Each key which is used here and will be used hereafter designates a key switch constituted by a key image displayed on the display device 11A and a part of the touch switch 11B on the key image.

The control device 20 returns via S23 and S26 to S23 again when the user depresses no key. In other words, the control device 20 is on standby for depression of either normal sewing mode key 11Ba or embroidery sewing mode key 11Bb. When the guidance key 11Bd is depressed, the explanation of operation is displayed. The control sequence for this purpose is eliminated.

When the user depresses the normal sewing mode key 11Ba, the control device 20 proceeds to S24 to determine whether the embroidery frame moving device 30 has been attached to the sewing machine body M. When the embroidery frame moving device 30 has been attached to the sewing machine body M, the control device 20 proceeds to S25 to warn the user that the normal sewing mode cannot be selected, then returning to S23. The reason for this is that the normal sewing cannot be carried out when the embroidery frame moving device 30 is attached to the sewing machine body M. The warning is displayed on the touch panel 11.

When the embroidery frame moving device 30 is not attached to the sewing machine body M (S24: NO), the control device 20 proceeds to S28 to carry out the same control manner as in the previous case where the enabling flag is set at "0." However, the processing at S40 differs from the above-described. After the enabling flag has been set at "1," an operation mode selecting screen as shown in FIG. 7 is displayed, and the normal sewing mode key 11Ba and the embroidery sewing mode key 11Bb are displayed on the display 11A. Accordingly, at S40, the control device 20 determines whether either mode selecting key (operation mode selecting switch) has been depressed. When neither key has been depressed, the control device 20 proceeds via S41 to S29. In this case, the control is the same as in the case where the enabling flag is set at "0."

The control device 20 returns to S23 when either mode selecting key has been depressed at S40. Then, the control device 20 determines whether either key has been depressed at S23 and S26. Accordingly, after the enabling flag has been set at "1," the embroidery sewing mode key 11Bb is depressed so that the operation mode can be changed from the normal sewing mode to the embroidery sewing mode. On the other hand, when the normal sewing mode key 11Ba is depressed, the operation mode can be changed from the embroidery sewing mode to the normal sewing mode. The embroidery sewing mode is also selectable even when the embroidery frame moving device 30 is not attached to the sewing machine body M. As a result, a work for editing an embroidery pattern can be carried out even when the embroidery frame moving device 30 is not attached to the sewing machine body M, as will be described later.

When the normal sewing mode key 11Ba is not depressed on the operation mode selecting screen shown in FIG. 7 (S23: NO), the control device 20 returns to S26 to determine the status of the embroidery sewing mode key 11Bb. When the embroidery sewing mode key 11Bb is not depressed either, the control device 20 returns to S23. When the embroidery sewing mode key 11Bb has been depressed, the control device 20 proceeds to S27.

Figure 8:
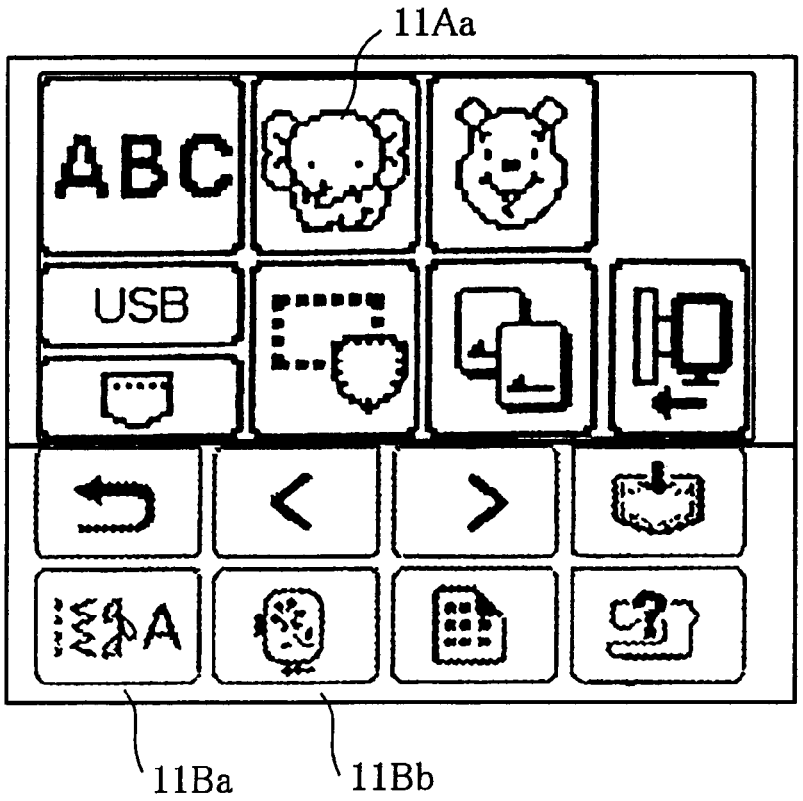
FIG. 8 shows an example of embroidery pattern type selecting screen.

The operation mode is changed to the embroidery sewing mode at S27. The control device 20 then proceeds to S42 in FIG. 5. S42 to S46 is a control sequence for accepting selection of an embroidery pattern by the user. Firstly, an embroidery pattern type selecting screen exemplified in FIG. 8 is displayed on the touch panel 11 at S42. A lower part of the screen is the same as the operation mode selecting screen in FIG. 7. An upper part of the screen is the embroidery pattern type selecting screen. A plurality of keys for selecting an embroidery pattern type are displayed on the top of the screen.

Figure 9:
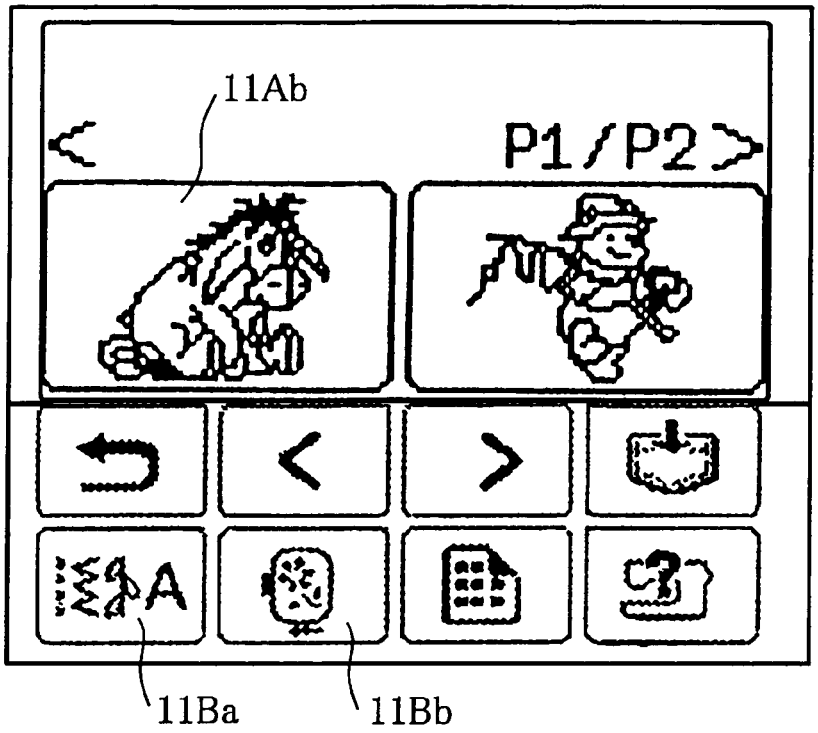
FIG. 9 shows an example of embroidery pattern selecting screen.

The user depresses a key corresponding to a desired one of embroidery pattern types on display (S43), for example, a key 11Aa corresponding to "first animal group." The control device 20 reads data of embroidery patterns belonging to the selected type, "first animal group" from the non-volatile memory 25, displaying the read data as an embroidery pattern selecting screen as exemplified in FIG. 9 on the touch panel 11. Two types of embroidery patterns belonging to the type, "first animal group" are displayed on an upper part of the screen in the example of FIG. 9.

Figure 10:
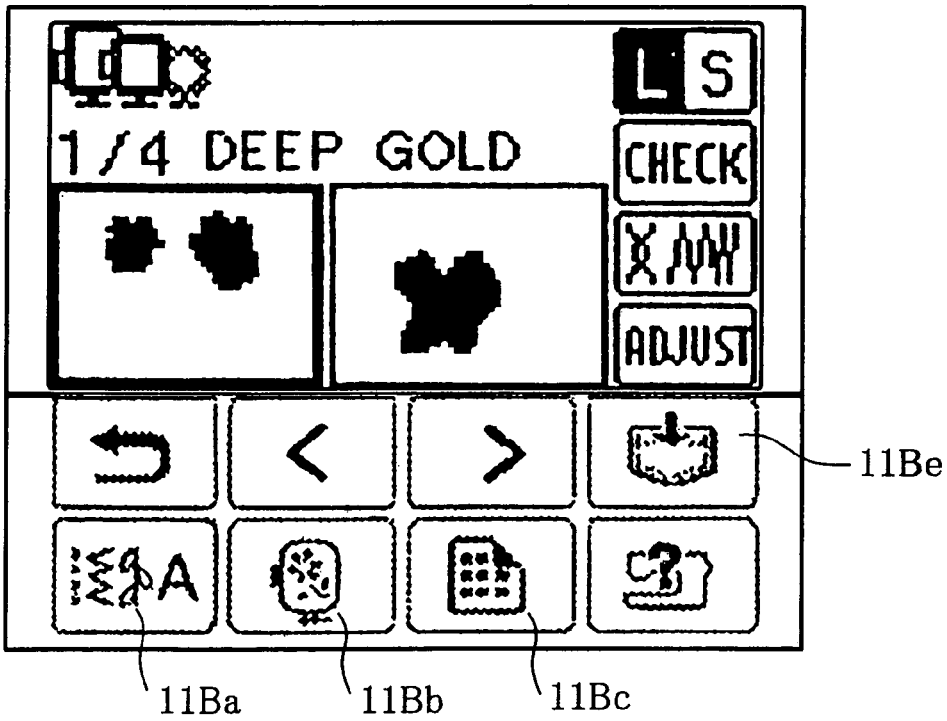
FIG. 10 shows an example of screen displaying the selected embroidery pattern.

The user selects a desired one of embroidery patterns. For example, the user depresses a key 11Ab corresponding to an embroidery pattern, "horse" (S45: YES). The control device 20 displays the selected embroidery pattern, "horse" as a selected embroidery pattern display screen as exemplified in FIG. 10 (S46). Each one embroidery pattern comprises a plurality of combined pattern elements. Accordingly, every pattern element composing the selected embroidery pattern of "horse" is displayed in the order sewn.

When the selection of embroidery pattern by the user is completed, the control device 20 proceeds to S47 to determine whether the edit key 11Bc has been depressed. The edit key 11Bc is displayed only when the selection of embroidery pattern at S45 has been completed. When the edit key 11Bc has not been depressed (S47: NO), the control device 20 proceeds to S29.

The control device 20 then determines whether the start/stop switch 12 has been depressed. When the start/stop switch 12 has not been depressed, the control device 20 proceeds to S40 to determine whether the mode selecting keys 11Ba and 11Bb have been depressed. When the mode selecting keys 11Ba and 11Bb have not been depressed, the control device 20 proceeds via S41 and S42 to S43 to determine whether the embroidery pattern type selecting key (the key 11Aa or the like in FIG. 8) has been depressed. When the embroidery pattern type selecting key has not been depressed, the control device 20 proceeds to S47 to determine whether the edit key 11Bc has been depressed. When the edit key 11Bc has not been depressed, the control device 20 returns to S29. The above-described determination is repeated until the start/stop key 12 or any one of the aforementioned keys is depressed.

Accordingly, the user depresses the embroidery pattern selecting key when having selected an embroidery pattern at S43 to S45 but wishes to change the selected embroidery pattern to another. Then, the control device 20 returns from S43 to S44, so that the user can select an embroidery pattern.

The user depresses the start/stop switch 12 when the embroidery pattern is specified and the user wishes to start to sew the embroidery pattern. The control device 20 then proceeds from S29 to S30. The control device 20 further proceeds via determination at S30 to S32 where the control device 20 determines whether the operation mode has been set at the embroidery sewing mode. Since the operation mode has been set at the embroidery sewing mode, the control device 20 proceeds to S33.

At S33, the control device 20 determines whether the embroidery frame moving device 30 has been attached to the sewing machine body M. When the embroidery frame moving device 30 has not been attached, the control device 20 warns the user that the embroidery frame moving device 30 has not been attached (S34), returning to S23. The warning is displayed on the touch panel 11. When the start/stop switch 12 is depressed under the embroidery sewing mode, the control device 20 determines, before start of the sewing operation, whether the embroidery frame moving device 30 has been attached to the sewing machine body M. As a result, an erroneous operation by the user can be prevented.

The control device 20 proceeds to S35 when the embroidery frame moving device 30 has been attached to the sewing machine body M (S33: YES). At S35, the control device 20 determines whether selection of an embroidery pattern has been completed. When the selection has not been completed, the control device 20 warns the user that the embroidery pattern selection has not been completed (S36), returning to S29. Since the embroidery pattern selection is thus checked, an erroneous operation by the user can be prevented.

When determining at S35 that the embroidery pattern selection has been completed, the control device 20 proceeds to S37 to start an embroidery sewing operation according to the selected embroidery pattern. The control device 20 reads, from the non-volatile memory 25, sewing data on which the embroidery pattern selected by the user is sewn. The sewing machine motor 17 is driven so that the needle bar 5 is moved vertically. The X-direction and Y-direction motors 33 and 34 are driven in synchronization with the vertical movement of the needle bar 5, so that an embroidery frame 31 is moved in the X- and Y-directions. An amount of movement is controlled according to the read data, whereby the selected embroidery pattern is sewn on the work cloth.

After starting the embroidery pattern sewing operation, the control device 20 proceeds to S38 to determine whether the start/stop switch 12 has again been turned on. When the start/stop switch 12 is not turned on, the control device 20 again returns to S38 to repeat the determination. Thus, the embroidery sewing operation is continued until the start/stop switch 12 is turned ON again.

When the user depresses the start/stop switch 12 again, the control device 20 proceeds to S39 to stop the sewing operation. After stop of the sewing operation, the control device 20 returns to S40 to determine whether the mode selecting switches 11Ba and 11Bb have been depressed. When the mode selecting switches 11Ba and 11Bb have been depressed, the control device 20 returns to S23 to determine the operation mode. When the mode selecting switches 11Ba and 11Bb have not been depressed, the control device 20 proceeds to S41 to determine whether the operation mode has been set at the embroidery sewing mode. The control device 20 proceeds to S42 since the sewing machine is in operation under the embroidery sewing mode in this case.

S42 to S46 constitutes the above-described control sequence for selection of the embroidery pattern. When the selected embroidery pattern is changed to another, the user selects an embroidery pattern in the same manner as described above. The control device 20 proceeds to S47 whether the embroidery pattern has been selected or not. At S47, the control device 20 determines whether the edit key 11Bc has been depressed. When the edit key 11Bc has not been depressed, the control device 20 proceeds to S29 to determine again whether the start/stop switch 12 has been depressed. As the result of the foregoing control sequence, the control device 20 re-starts an embroidery sewing operation when the sewing operation has been stopped (S39) and thereafter the start/stop switch 12 has been depressed without depression of other keys. The user can complete the selected embroidery pattern by the repeated sewing operation.

Next, a control sequence will be described which is executed when the user edits the selected embroidery pattern. In this case, the user depresses the edit key 11Bc. When the edit key 11Bc has been depressed, the control device 20 determines at S47 that the edit key 11Bc has been depressed, proceeding to S48. The control device 20 previously provides an edit mode flag in the RAM 24. The edit mode flag is set at ON when the edit mode is under execution. The edit mode flag is set at OFF when the edit mode is not under execution. The edit mode flag is set at OFF immediately after power supply to the control device 20.

At S48, the control device 20 determines whether the edit mode flag is set at ON. When the edit mode flag is set at ON, the control device 20 sets the edit mode flag to OFF, then returning to S29. That is, the edit mode flag serves as an alternate switch. When the edit mode flag is set at OFF, the control device 20 proceeds to S51 in FIG. 6. At S51, the control device 20 determines whether an embroidery pattern has been selected. When the embroidery pattern has not been selected, the control device 20 proceeds to S52 to warn the user that an embroidery pattern has not been selected, then returning to S29. The reason for the warning is that editing cannot be carried out without selection of an embroidery pattern.

Figure 11:
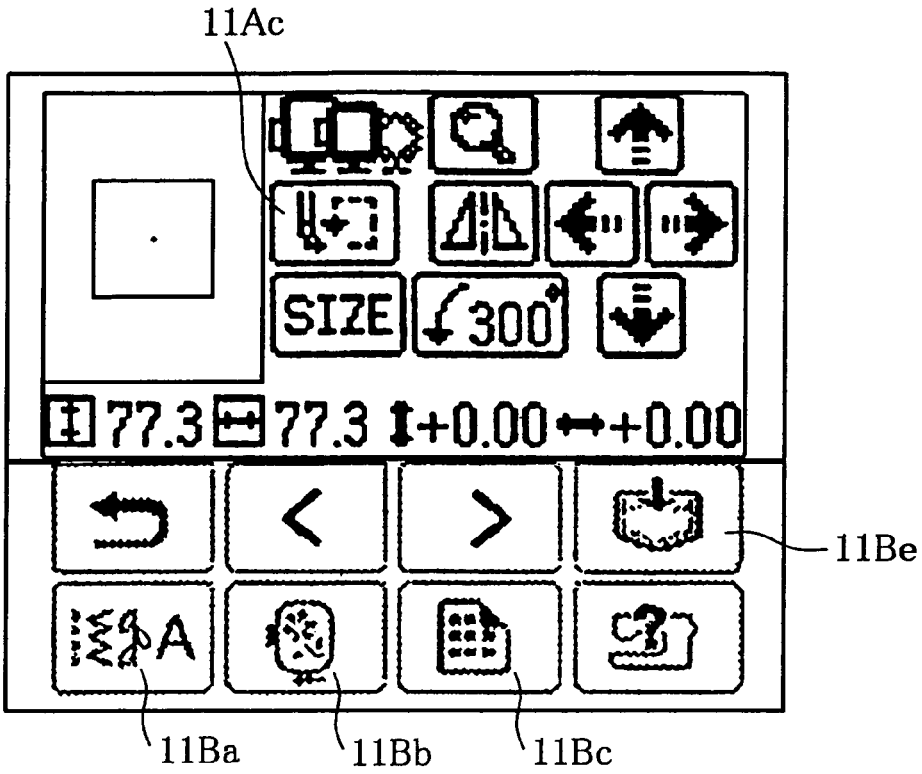
FIG. 11 shows an example of edit screen.

When an embroidery pattern has been selected, the control device 20 proceeds to S53 to turn the edit mode flag ON. The subsequent S54 to S66 constitute a control sequence of the edit mode. At S54, an edit screen as exemplified in FIG. 11 is displayed. The user instructs to edit the selected embroidery pattern using various edit keys displayed on the edit screen. The control device 20 carries out edit processing in response to the instruction by the user (S55). The edit processing includes scale-up, scale-down, turn, pattern addition, pattern elimination, and the like.

Figure 12:
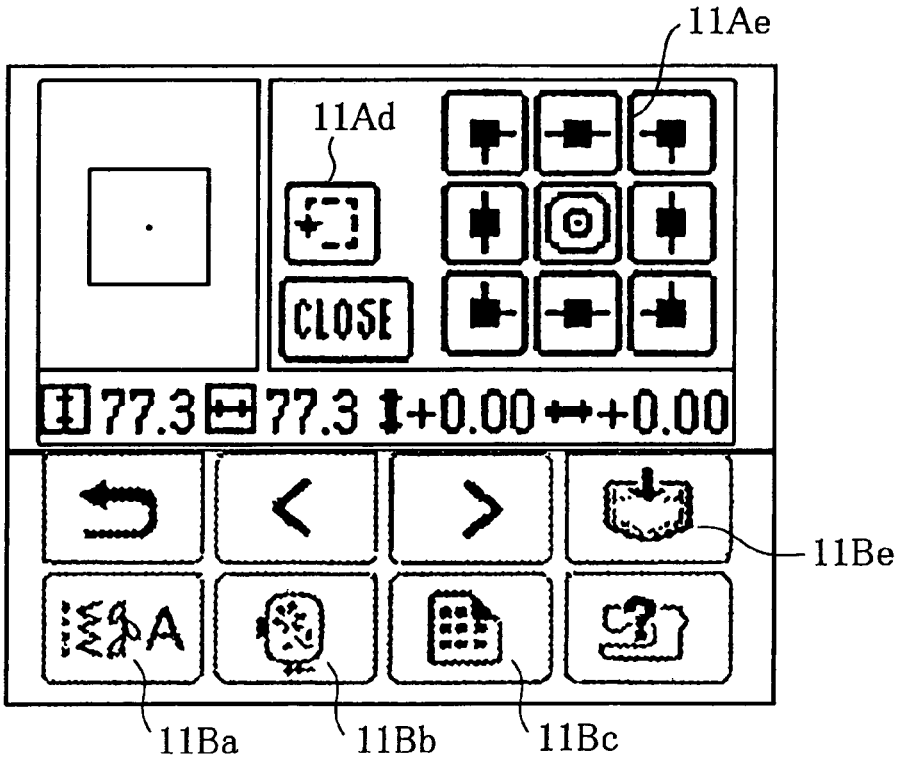
FIG. 12 shows an example of screen for changing an embroidery starting point.

Upon completion of edit, the user depresses any one of start-point change key 11Ac, store key 11Be and edit key 11Bc. When the start-point change key 11Ac to change an embroidery start-point has been depressed (S56: YES), the control device 20 proceeds to S57 where the control device 20 determines whether the embroidery frame moving device 30 has been attached to the sewing machine body M. When the embroidery frame moving device 30 has been attached, the control device 20 displays an embroidery start-point change screen as exemplified in FIG. 12 (S58). The user operates nine navigation keys 11Ae on the right upper part of the screen, thereby instructing the change of embroidery start-point. The control device 20 carries out change processing for moving the embroidery frame moving device 30 according to the instructions (S59).

Upon completion of the change in the embroidery start-point, the user depresses a trace key 11Ad on the screen to instruct tracing. The tracing is actually moving only the embroidery frame moving device 30 based on data of edited embroidery pattern so that it is confirmed whether a needle 6 correctly draws the embroidery pattern. When the trace key 11Ad is turned ON (S60: YES), the control device 20 proceeds to S61 to operate only the embroidery frame moving device 30 without vertical movement of the sewing needle 6 (S61). The control device 20 proceeds to S63 after completion of operation of the embroidery frame moving device 30. When tracing is not instructed (S60: NO), the control device 20 proceeds to S63.

Figure 13:
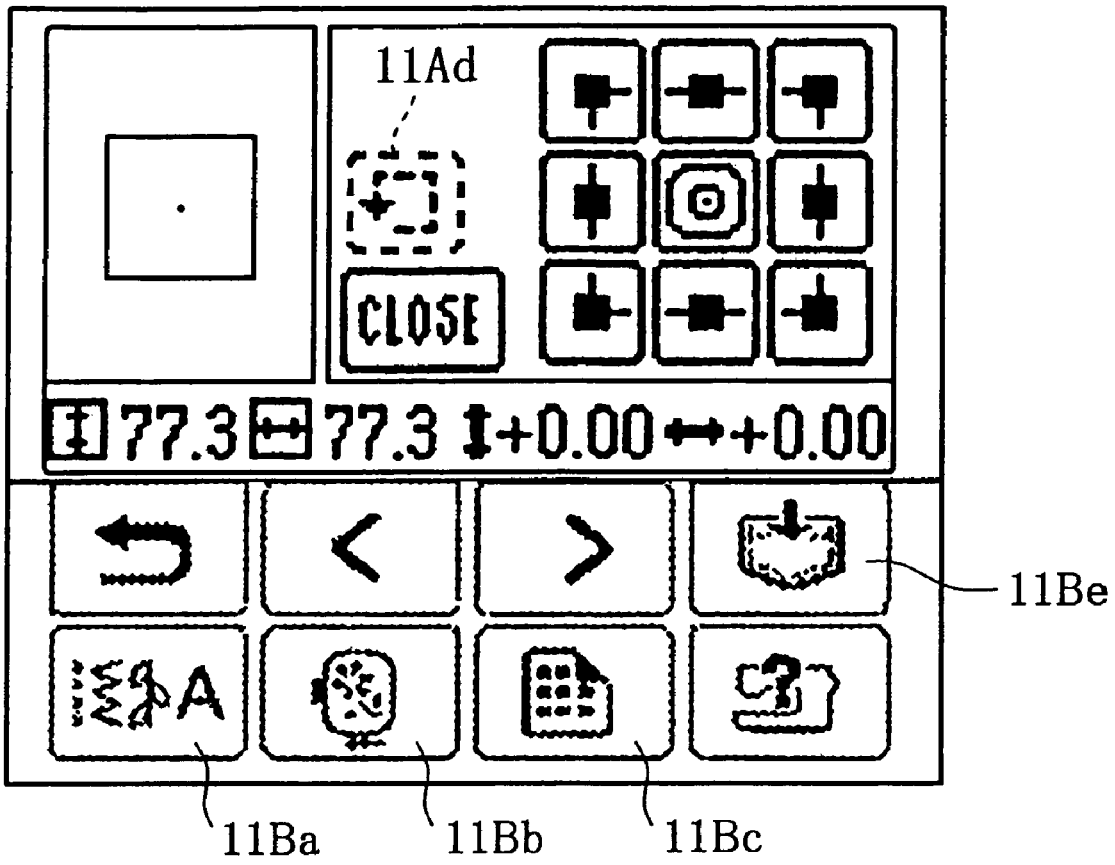
FIG. 13 shows an example of screen for changing an embroidery starting point with a trace key 11Ad being displayed in gray.

When determining at S57 that the embroidery frame moving device 30 has not been attached, the control device 20 proceeds to S62 to display an embroidery start-point change screen in which the trace key 11Ad has been changed to gray display (halftone display), as shown in FIG. 13. The control device 20 then proceeds to S63. The control device 20 also proceeds to S63 when the start-point change key 11Ac has not been detected at S56.

At S63, the control device 20 determines whether the storage key 11Be has been depressed. When the storage key 11Be has been depressed, the control device 20 proceeds to S64 to write data of the embroidery pattern edited at S55 onto the non-volatile memory 25. The control device 20 then proceeds to S65. The control device 20 also proceeds to S65 also when the storage key 11Be has not been depressed at S63.

At step S65, the control device 20 determines whether the edit key 11Bc has been depressed. When the edit key 11Bc has not been depressed, the control device 20 returns to S54, to repeat the edit processing. When the edit key 11Bc has been depressed, the control device 20 sets the edit mode flag to OFF, thereafter ending the edit mode (S66). The control device 20 then returns to S29. In case that the edit processing has been carried out, the embroidery sewing operation is carried out based on data of edited embroidery pattern when the start/stop switch 12 is depressed.

As described above, the user can operate the sewing machine as a sewing machine dedicated to the normal sewing before the embroidery frame moving device 30 is initially attached to the sewing machine body M. In this case, display, explanation, switches and the like peculiar to the embroidery sewing mode are eliminated although the control device 20 has a function of controlling the sewing machine under the embroidery sewing mode. Accordingly, the user can devote himself/herself to the normal sewing without being perplexed by the aforementioned display, explanation, switches and the like peculiar to the embroidery sewing mode. On the other hand, the manufacturer can sell a sewing machine which is dedicated to the normal sewing but can carry out the embroidery sewing and normal sewing.

Furthermore, after the embroidery frame moving device 30 is attached to the sewing machine body M even once, the user can selectively carry out either embroidery sewing or normal sewing. In this case, when an embroidery sewing operation is instructed without the embroidery frame moving device 30 being attached or when the normal sewing mode has been selected with the embroidery frame moving device 30 being attached, the control device 20 warns the user, whereupon an erroneous operation can be prevented. Consequently, safety can be ensured in the operation of the sewing machine.

The above-described embodiment can be modified as follows.

(1) Although various warning messages are displayed on the touch panel 11 in the foregoing embodiment, a warning buzzer may be actuated with or without display of warning message.

(2) Although data on embroidery patterns is stored on the non-volatile memory 25 in the foregoing embodiment, data on embroidery patterns may be read out of an external ROM card 40 as shown in FIG. 2. Furthermore, data on embroidery patterns may be read out of an external computer by way of communication, and data of edited embroidery pattern may be transmitted to the external computer to be stored.

(3) Although execution or non-execution of attachment of the embroidery frame moving device 30 is detected by a potential change in the input port P due to connection or non-connection of the connector 14, execution or non-execution of attachment of the embroidery frame moving device 30 may be detected by a mechanical switch such as a limit switch or a photoelectric switch.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a sewing machine body;

an embroidery frame moving device detachably attachable to the sewing machine body, wherein an embroidery sewing operation is executable when the embroidery frame moving device is attached to the sewing machine body, and a normal sewing operation is executable when the embroidery frame moving device is detached from the sewing machine body;

a control device including a detector which detects the embroidery frame moving device attached to the sewing machine body, the control device controlling the sewing machine in a first stage under only a normal sewing mode in which the normal sewing operation is executed, the first stage ending when the detector detects the embroidery frame moving device initially attached to the sewing machine body, the control device controlling the sewing machine in a second stage under either the normal sewing mode or an embroidery sewing mode in which the embroidery sewing operation is executed, the second stage starting after the detector has detected the embroidery frame moving device attached to the sewing machine body; and a display that is capable of displaying options for the normal sewing operation and options for the embroidery sewing operation, wherein when the sewing machine is in the first stage, the display only displays options for the normal sewing operation and does not display options for the embroidery sewing operation.

2. The sewing machine according to claim 1, wherein the control device includes an operation mode selecting switch selecting either embroidery sewing mode or normal sewing mode at the second stage, and the control device controls the sewing machine under an operation mode selected by the operation mode selecting switch whether the embroidery frame moving device has been attached to the sewing machine body or not.

3. The sewing machine according to claim 1, wherein the control device includes a non-volatile memory and stores data of attachment of the embroidery frame moving device to the sewing machine body when the embroidery frame moving device attached to the sewing machine body is initially detected by the detector.

4. The sewing machine according to claim 1, wherein the control device carries out the embroidery sewing operation only when the embroidery frame moving device is attached to the sewing machine body even in the second stage.

5. The sewing machine according to claim 1, wherein when instructed to execute the normal sewing operation while the embroidery frame moving device is attached to the sewing machine body, the control device warns that the normal sewing operation cannot be executed.

6. A method of controlling a sewing machine including a sewing machine body, a display, an embroidery frame moving device detachably attachable to the sewing machine body and a control device, wherein an embroidery sewing operation is executable when the embroidery frame moving device is attached to the sewing machine body, and a normal sewing operation is executable when the embroidery frame moving device is detached from the sewing machine body, the display capable of displaying options for the normal sewing operation and options for the embroidery sewing operation, the method comprising:

controlling the sewing machine in a first stage under only a normal sewing mode in which the normal sewing operation is executed, the first stage ending upon detection of the embroidery frame moving device initially attached to the sewing machine body;

controlling the sewing machine in a second stage under either the normal sewing mode or an embroidery sewing mode in which the embroidery sewing operation is executed, the second stage starting upon detection of the embroidery frame moving device attached to the sewing machine body; and displaying on the display only options for the normal sewing operation without displaying options for the embroidery sewing operation, when the sewing machine is in the first stage.

7. The method according to claim 6, wherein the control device includes an operation mode selecting switch selecting either embroidery sewing mode or normal sewing mode at the second stage, and the control device controls the sewing machine under an operation mode selected by the operation mode selecting switch whether the embroidery frame moving device has been attached to the sewing machine body or not.

8. The method according to claim 6, wherein the control device includes a non-volatile memory and stores data of attachment of the embroidery frame moving device to the sewing machine body upon detection of the embroidery frame moving device initially attached to the sewing machine body.

9. The method according to claim 6, wherein the control device carries out the embroidery sewing operation only when the embroidery frame moving device is attached to the sewing machine body even in the second stage.

10. The method according to claim 6, wherein when instructed to execute the normal sewing operation while the embroidery frame moving device is attached to the sewing machine body, the control device wams that the normal sewing operation cannot be executed.

11. The sewing machine according to claim 1, wherein the display includes a touch panel that allows a user to select the displayed options, the touch panel does not show options for embroidery sewing operations when the sewing machine is in the first stage.

12. The method according to claim 6, wherein the display includes a touch panel that allows a user to select the displayed options, the touch panel does not show options for embroidery sewing operations when the sewing machine is in the first stage.

* * * * *